US006716010B2

(12) United States Patent
Eaton et al.

(10) Patent No.: US 6,716,010 B2
(45) Date of Patent: Apr. 6, 2004

(54) BEARING ARRANGEMENT

(76) Inventors: Mark Stephen Eaton, 64 Common Lane, Polesworth, Staffordshire (GB), B78 1LY; Ian Kimber, 84 Swancote Road, Stechford, Birmingham (GB), B33 9JE ( * ) Notice: Subject to any disclaimer, the term of this patent is extended or adjusted under 35 U.S.C. 154(b) by 0 days.

(21) Appl. No.: 10/172,800

(22) Filed: Jun. 14, 2002

(65) Prior Publication Data

US 2003/0053923 A1 Mar. 20, 2003

(30) Foreign Application Priority Data

Jun. 14, 2001 (GB) ..... 0114434

(51) Int. Cl.[7] ..... F03C 02/00

(52) U.S. Cl. ..... 418/132; 418/206.7; 418/206.8; 418/178; 418/179

(58) Field of Search ..... 418/132, 206.7, 418/178, 179, 206.8

(56) References Cited

U.S. PATENT DOCUMENTS

| | | | | |
|---|---|---|---|---|
| 2,982,220 A | | 5/1961 | Kane | |
| 3,073,251 A | * | 1/1963 | Weigert | 418/132 |
| 3,632,240 A | | 1/1972 | Dworak | |
| 3,778,200 A | * | 12/1973 | Wellman | 418/132 |
| 3,981,646 A | * | 9/1976 | Bottoms | 418/190 |
| 4,017,224 A | * | 4/1977 | Jons | 418/131 |
| 4,311,445 A | | 1/1982 | Eley et al. | |
| 4,523,365 A | | 6/1985 | Richmond | |
| 4,830,592 A | * | 5/1989 | Weidhaas | 418/132 |
| 5,022,837 A | * | 6/1991 | King et al. | 418/132 |

* cited by examiner

*Primary Examiner*—Thomas Denion
*Assistant Examiner*—Theresa Trieu
(74) *Attorney, Agent, or Firm*—Brown Raysman Millstein Felder & Steiner LLP

(57) ABSTRACT

A bearing arrangement for a gear pump comprises first and second separate bearing blocks each having a respective block housing. The first and second bearing blocks together defining an axially directed bearing surface including a bridge region formed from an erosion resistant material which acts to separate inlet and outlet ports of the pump and a second region formed from a reduced friction material. The bridge region is defined by first and second insert members cast within respective ones of the block housings. The first and second bearing blocks are arranged such that respective surfaces of the first and second insert members mate with one another, and the first and second insert members are arranged such that the bridge region of the bearing surface is flush with the second region.

6 Claims, 4 Drawing Sheets

BEARING ARRANGEMENT

BACKGROUND OF THE INVENTION

1. Field of Invention

The present invention relates to a bearing arrangement for use in a gear pump having an axially directed bearing surface including a region which acts to separate inlet and outlet ports of the pump. In particular, the invention relates to a bearing arrangement for use in a gear pump of the type used in an aircraft engine.

2. Description of Related Art

A conventional gear pump having a pair of intermeshed, externally toothed gear elements, is described in GB 2012876 A. Bearing blocks are used in pairs to provide a bearing surface for the teeth and drive shafts of the gears. Each gear tooth has a "working flank" which engages the teeth of the other gear and a trailing, "non-working" flank, a small clearance referred to as the "backlash gap" being defined between the non-working flank and the other gear. During operation, there are periods for which two working flanks of one gear are in engagement with working flanks on the other gear, causing a small quantity of fluid to be trapped in a volume, referred to as the inter-tooth volume, between the inter-engaged working flanks. The inter-tooth volume, defined between the two pairs of working flanks which are in contact, includes the backlash gap.

As the gears rotate, the inter-tooth volume first decreases and subsequently increases. During this volume change, the proportions of the inter-tooth volume on respective sides of the backlash gap also alter. The volume changes within the inter-tooth volume result in transient pressure changes in that volume. Such pressure changes result in air coming out of solution and the creation of vapour bubbles from the pumped fluid. A subsequent increase in pressure will result in collapse of the vapour bubbles. It is a particular problem in aircraft, when the pump is being used at high altitudes, that the collapse of the vapour bubbles causes cavitation erosion of the portions of the bearing surface which act to separate the pump inlet and outlet. The erosion of the end face of the bearing surface increases the leakage path between the outlet and inlet sides of the pump, therefore reducing pump efficiency. The presence of the leakage path reduces the efficiency of the pump and requires premature replacement of the bearing arrangement.

It has been proposed to overcome the problem of erosion of the bearing surface in this way by forming the bearing blocks, or the end faces of the bearing blocks, from a hard material. However, the forming of the bearing from a hard material can detract from the primary function of providing a bearing surface for the gears.

U.S. Pat. No. 4,311,445 describes a bearing arrangement for a gear pump of the type comprising a single bearing block having a 'figure of eight' configuration. A hard insert extends over the vulnerable region of the bearing surface in the form of a pin set in a central region of the block. However, as the arrangement includes only a single bearing block, it is not possible to profile the central region to further reduce the cavitation problem described previously. Furthermore, it can be desirable to locate drillings near the region of engagement of the gear teeth to provide a path for lubrication fluid to flow to the paths and it is not possible to do this in a figure of eight bearing block. A further disadvantage of this arrangement is that, if the hard pin is not perfectly flush with the surrounding bearing surface or comes loose through vibration and contacts the gear teeth, a catastrophic failure of the pump may occur. The use of the gear pump as a fuel pump for an aircraft engine cannot therefore be contemplated.

It has been previously proposed to mitigate the effects of cavitation damage in a twin bearing block arrangement by locating a hard steel insert in each of the two blocks. Each insert is located in an end portion of respective cylindrical lead-bronze bearing blocks and is secured therein by means of a locking pin which extends through a drilling in the mating surfaces of the blocks. Whilst the provision of the locking pin prevents the insert becoming loose, in order to avoid the possibility of the insert contacting the rotating gears, it is necessary for the insert to be located fractionally below the bearing surface. The small clearance between the surface of the insert and the bearing surface for the gear teeth and gear shafts provides a leakage path for fuel which reduces the efficiency of the pump. Furthermore, the bearing arrangement is expensive to manufacture as a large portion of the steel liner must be removed by machining following assembly to profile the outer surface of the block.

It is an object of the present invention to provide a bearing arrangement for a gear pump suitable for use in an aircraft engine in which the aforementioned problems are reduced or avoided.

According to a first aspect of the present invention, a bearing arrangement for a gear pump comprises first and second separate bearing blocks each having a respective block housing, the first and second bearing blocks together defining an axially directed bearing surface including a first region formed from an erosion resistant material which acts to separate inlet and outlet ports of the pump and a second region formed from an anti-friction material, wherein the first region is defined by first and second insert members cast within respective ones of the block housings, the first and second bearing blocks being arranged such that respective surfaces of the first and second insert members mate with one another, the first and second insert members being arranged such that the first region of the bearing surface is flush with the second region.

The casting of the insert members within the block housings and the subsequent machining of the cast insert member and block housing arrangement ensures the bridge region is flush with the remainder of the bearing surface, thereby ensuring substantially no leakage path exists between the outlet and inlet sides of the pump which would otherwise reduce pump efficiency. Additionally, as the insert members are cast within the block housings, there is no need for a separate hard liner and separate locking pins to secure the insert members in place. The cost of manufacturing the bearing arrangement is therefore reduced considerably.

In a preferred embodiment of the invention, the erosion resistant material is stainless steel.

Preferably, the block housings are cast from a lead-bronze material such as, for example, Tokat 30.

Each of the bearing blocks is preferably provided with an inlet relief in communication with the inlet of the pump and an outlet relief in communication with the outlet of the pump, the bridge region of the bearing surface being defined between the inlet and outlet reliefs.

One or more of the relieved regions of the bearing surface is preferably provided with a drilling or passage which communicates with a through bore provided in the respective bearing block to provide a supply of lubricating fluid within said bore.

According to a second aspect of the present invention, a bearing arrangement for a gear pump comprises first and second separate bearing blocks each having a respective block housing, the first and second bearing blocks together defining an axially directed bearing surface formed from a reduced friction material, except for a bridge region formed from an erosion resistant material which acts to separate inlet and outlet ports of the pump, wherein said bridge region is defined by first and second insert members cast within respective ones of the block housings and machined to be flush with the remainder of the bearing surface.

According to another aspect of the present invention, a method of assembling a bearing arrangement for a gear pump comprises the steps of;

providing an insert member, including a projection, formed from an erosion resistant material, casting a reduced friction material over the insert member, to provide a cast block housing, such that the projection protrudes from an end face of the cast block housing, machining the end face of the cast block housing from which the projection protrudes such that the projection is detached from the remainder of the insert member, thereby to define an axially directed bearing surface comprising a first region defined by the insert member and a second region defined by the cast block housing, wherein the first region is substantially flush with the second region.

Preferably, the method includes the further step of coating an outer surface of the cast block housing with a coating material.

The method may further comprise the step of machining the coated outer surface of the bearing block to achieve the desired profile.

It will be appreciated that the aforementioned preferred features of the first aspect of the invention apply equally to the other aspects of the invention also.

BRIEF DESCRIPTION OF THE DRAWINGS

The invention will now be described, by way of example only, with reference to the accompanying drawings in which.

DETAILED DESCRIPTION OF THE INVENTION

Figure 1:
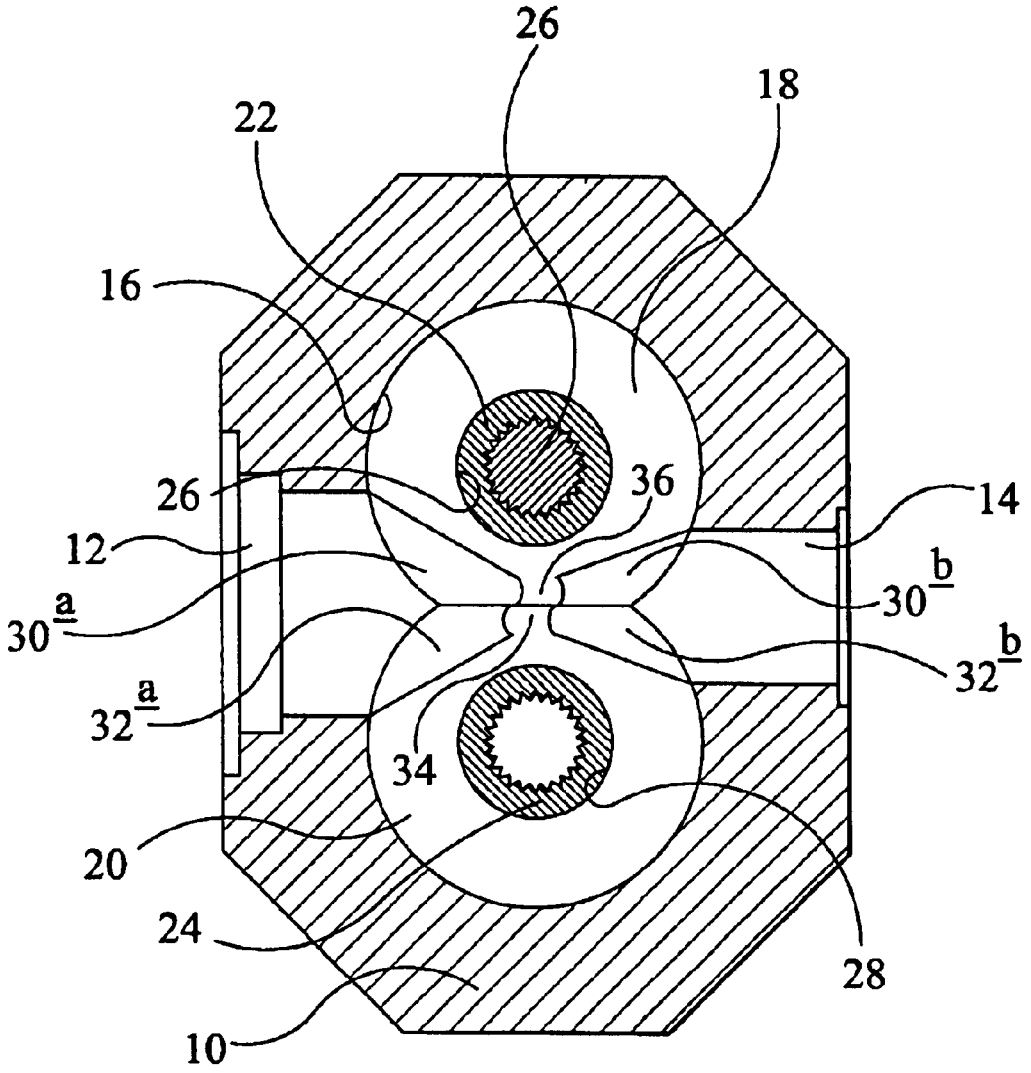
FIG 1 Prior art
FIG. 1 is a transverse sectional view of a gear pump of the type in which the bearing arrangement of the present invention may be used.

FIG. 1 shows a gear pump including a housing 10 defining an inlet port 12 and an outlet port 14 and being provided with a pair of identical parallel bores to define a chamber 16 within the housing 10. The gear pump is provided with a bearing arrangement comprising two pairs of substantially identical, part cylindrical bearing blocks 18, 20, only two of which are shown in FIG. 1. Each of the first and second bearing blocks 18, 20 is mounted within a respective one of the parallel bores. The axially directed end faces of the bearing blocks 18, 20 sealingly abut end faces of two gears, the region of mesh of the gears lying between the inlet port 11 and the outlet port 12 of the pump.

Shafts 22, 24 of the two meshed gears extend through further bores 26, 28 provided in the first and second bearing blocks 18, 20 respectively. The first gear shaft 22 is in connection with a splined drive shaft 26. Each of the first and second bearing blocks 18, 20 is provided with a pair of reliefs, 30*a*, 30*b* and 32*a*, 32*b* respectively, arranged such that one of the reliefs 30*a*, 32*a* communicates with the inlet port 12 and the other of the reliefs 30*b*, 32*b* communicates with the outlet port 14. The reliefs define therebetween respective bridge regions 34, 36 on each of the block end surfaces which prevent communication between the inlet port 12 and the outlet port 14. It is the bridge regions 34, 36 of the bearing blocks 18, 20 which are liable to cavitation erosion as a result of pressure changes within the inter-tooth volumes, as described previously.

Figure 2:
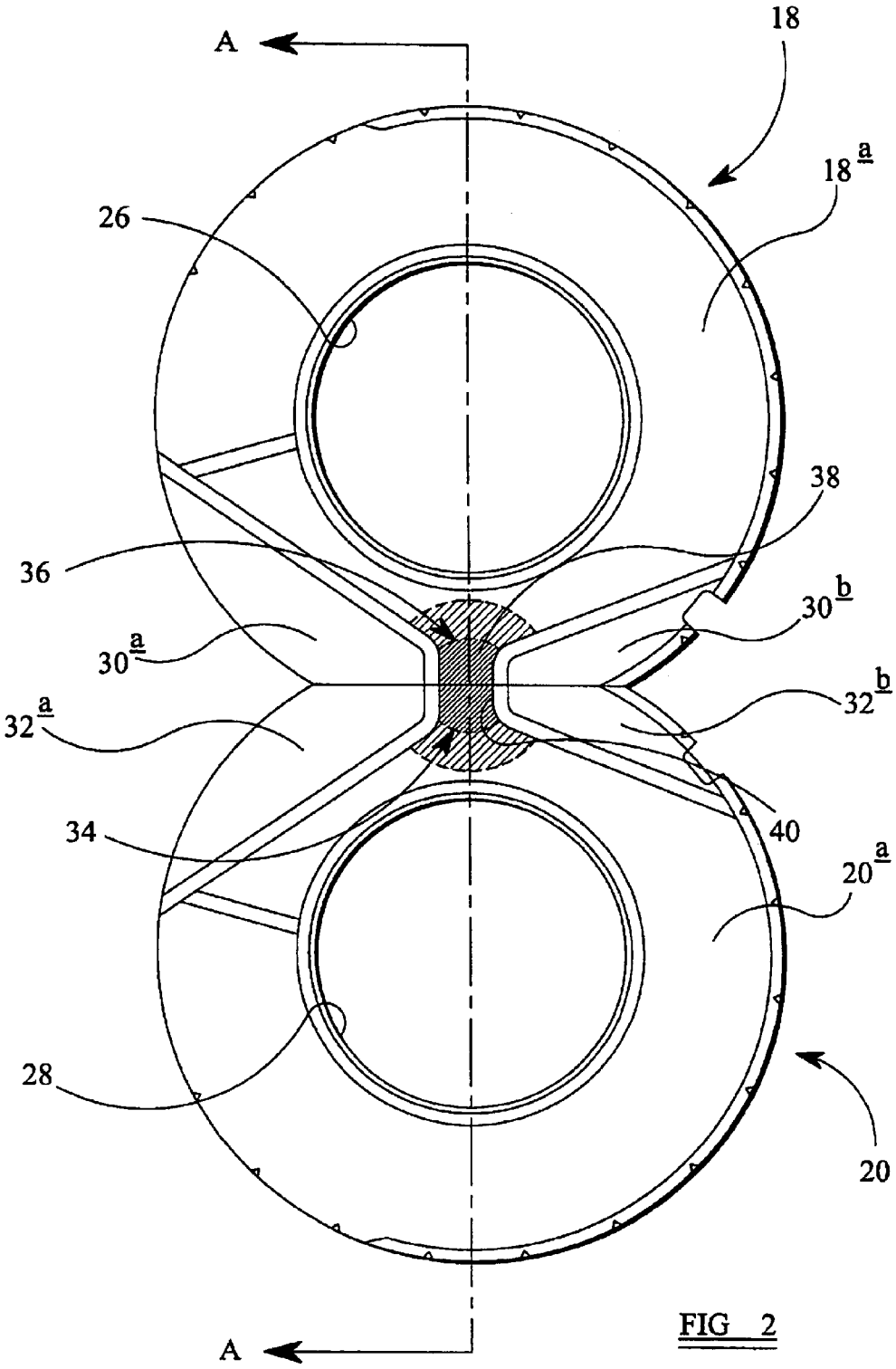
FIG. 2 is an enlarged, alternative transverse sectional view of first and second bearing blocks forming part of the gear pump in FIG. 1.

FIG. 2 shows an enlarged view of the bearing arrangement suitable for use in the gear pump in FIG. 1, and in which first and second insert members 38, 40 formed from an erosion resistant material are cast within the bridge regions 34, 36 respectively of the first and second bearing blocks 18, 20. Typically, the first and second insert members 38, 40 are formed from stainless steel to specification AMS 5848. Each of the first and second bearing blocks 18, 20 includes a block housing, 18*a*, 20*a* respectively, cast from a reduced friction material, such as lead-bronze, using the method described hereinafter.

The outer cylindrical surface of the bearing blocks 18, 20 is coated with a coating material (not shown in FIG. 2) such as aluminium. The axially directed end faces of the bearing blocks 18, 20 may be coated with a soft, low friction surface coating, for example lead indium.

Preferably, one or more of the regions of the bearing surface provided with the reliefs 30*a*, 32*a*, 30*b*, 32*b* is provided with a drilling or passage (not shown) in communication with a through bore (also not shown) provided in the respective bearing block 18, 20 to permit a supply of lubricating fluid within said bore. The passage are easy to drill by virtue of the twin block design.

Figure 3:
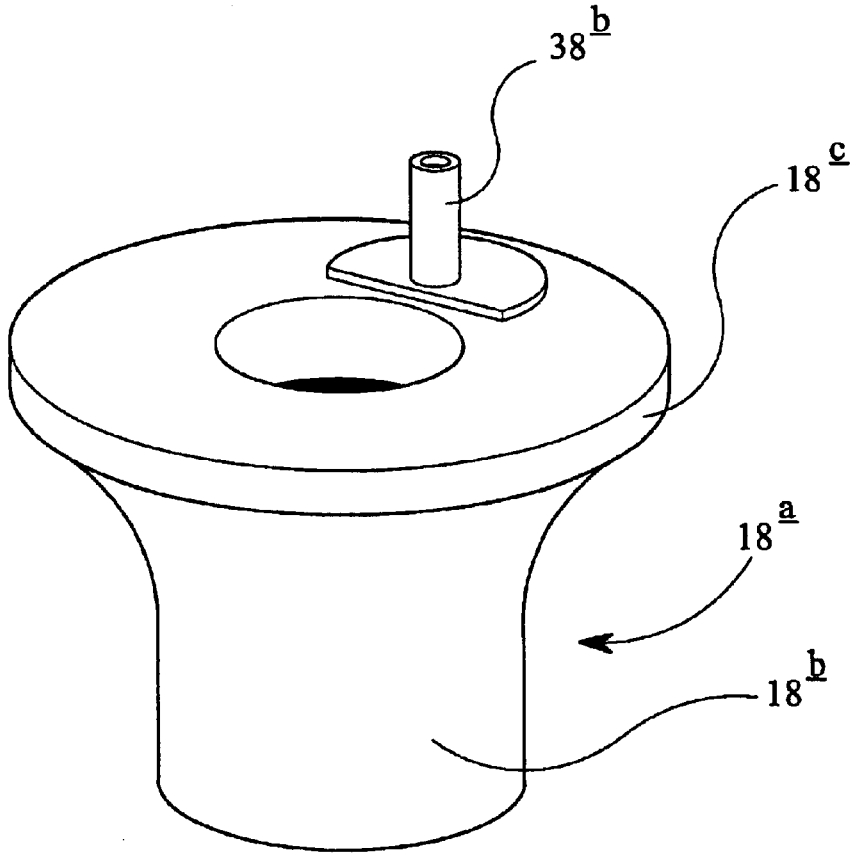
FIG. 3 is a perspective view of a part of a bearing block in FIGS. 1 and 2 when in an initial stage of manufacture.
Figure 4:
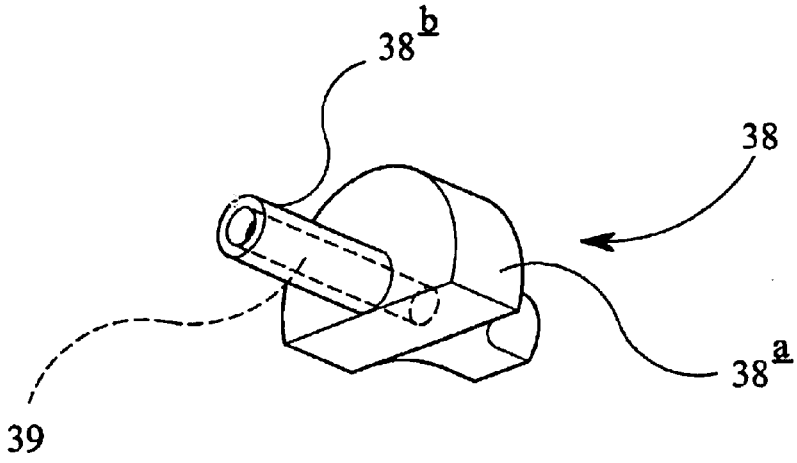
FIG. 4 is a perspective view of an insert member forming part of the bearing block in FIG. 3.
Figure 5:
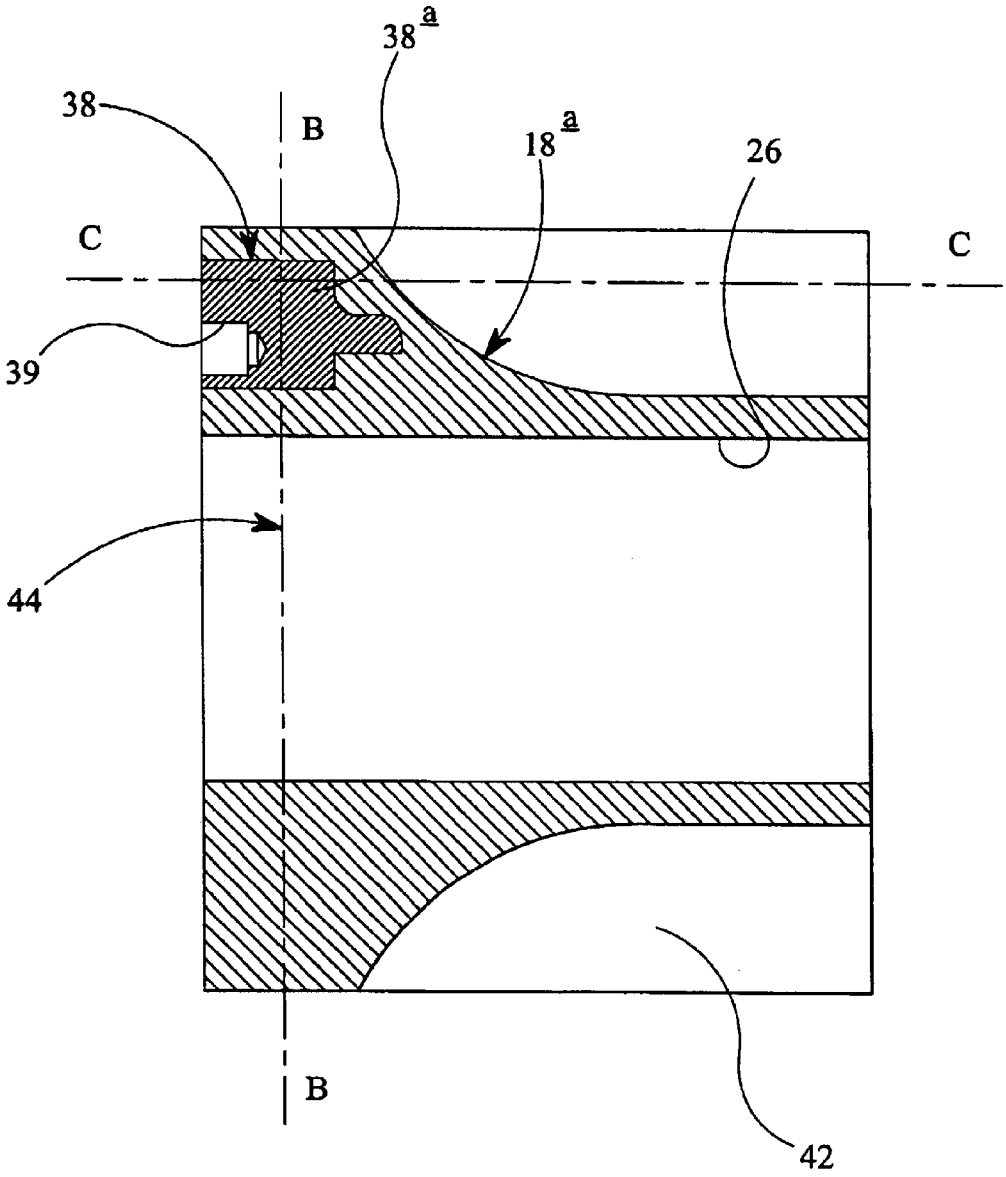
FIG. 5 is a sectional view, along line A—A in FIG. 2, of a bearing block during a final stage of manufacture.

FIGS. 3 and 4 illustrate parts of the first bearing block 18 during an early stage in manufacture. As can be seen in FIG. 4, the insert member 38 comprises a main body portion 38*a* and a projection 38*b* with a screw threaded bore 39. Initially, the projection 38*b* is mounted upon a external support or jig (not shown) and a material, such as lead-bronze, is cast over the main body portion 38*a* into a bell-shaped mould to cast the main body of the bearing block, resulting in a block housing 18*a* having a cylindrical portion 18*b* and an enlarged annular portion 18*c* as shown in FIG. 4. As can be seen in FIG. 5, the insert member 38 is provided with a screw threaded bore 39 which permits the insert member 38 to be mounted on the jig or support for the purpose of the casting process. Preferably, the material from which the block housing 18*a* is formed is a lead-bronze material such as Tokat 30.

FIG. 5 illustrates the first bearing block 18 during a subsequent stage in its manufacture, in which an upper region of the block housing 18*a* is removed along line B—B using a conventional machining process. The machining of the upper region from the remainder of the block housing 18*a* removes the projection 38*b* from the main body portion 38*a* of the insert member 38, thereby defining a flush bearing surface 44 (shown as a dashed line) which engages the gear teeth when the pump is in use.

It will be appreciated that the aforementioned manufacturing process provides the bearing arrangement with a bearing surface 44 comprising a first region defined by a surface of the insert member 38 which is formed from erosion resistant material and a second region defined by the block housing 18*a* which is formed from a friction reducing material. Thus, whilst the remainder of the bearing surface is formed from lead-bronze to provide a suitable bearing surface for the teeth and shafts of the gears, erosion of the bearing surface in the bridge region 34, 36 defined by the insert member is reduced and, hence, the problems associated with cavitation erosion are reduced.

In a subsequent stage in the manufacture of the bearing block 18, the outer surface of the bearing block 18 is coated with a coating material 42, preferably aluminium. The aluminium coating material 42 is machined to give the desired outer profile of the bearing arrangement. The method by which the outer surface of the block housing 18*a* of the bearing block 18 is coated may be that described in U.S. Pat. No. 4,523,365.

As indicated in FIG. 5, the aluminium coating 42 and the cast lead bronze is machined from the remainder of the bearing block 18 along dotted line C—C such that the outer surface of the bearing block 18 includes a region of steel defined by the insert member 38 which, when the bearing arrangement is assembled, mates with the corresponding outer surface of the second bearing block 20 defined by the second insert member, thereby defining an erosion resistant bridge region 34, 36 to separate the inlet and outlet ports 12, 14 of the pump.

Once the bearing block has been machined, appropriate passages are provided in the relieved regions 30*a,* 30*b,* the passages communicating with the bore 26 to provide a region of outlet pressure within the bore 26.

It will be appreciated that the second bearing block 20 forming part of the bearing arrangement in FIG. 2 may be manufactured using the same technique as described for the first bearing block 18. Appropriate passages may also be provided in the relieved regions 32*a,* 32*b* to provide a region of outlet pressure within the bore 28 of the second bearing block 20.

By manufacturing the bearing arrangement using the method of the present invention, it is possible to ensure that the region of the bearing surface 44 defined by the block housings 18*a,* 20*a* is exactly flush with the region of the bearing surface 44 defined by the insert member 38. Furthermore, by casting the material of the block housings 18*a,* 20*a* onto their respective insert members 38 it is possible to ensure the insert members 38 are securely mounted within the bearing blocks without the need for separate locking members.

It will be appreciated that the insert members 38, 40 may be formed from an erosion resistant material other than steel. The bearing blocks may be cast from any reduced friction material having properties which make it suitable for use as a bearing surface for gears, and need not be formed from lead-bronze.

We claim:

1. A bearing arrangement for a gear pump comprises first and second separate bearing blocks each having a respective block housing, the first and second bearing blocks together defining an axially directed bearing surface including a bridge region formed from an erosion resistant material which acts to separate inlet and outlet ports of the pump and a second region formed from a reduced friction material, wherein the bridge region is defined by first and second insert members cast within respective ones of the block housings, the first and second bearing blocks being arranged such that respective surfaces of the first and second insert members mate with one another, the first and second insert members being arranged such that the bridge region of the bearing surface is flush with the second region.

2. A bearing arrangement as claimed in claim 1, wherein the erosion resistant material is stainless steel.

3. A bearing arrangement as claimed in claim 1, wherein the block housings are cast from a lead-bronze material.

4. A bearing arrangement as claimed in claim 1, wherein each of the bearing blocks is provided with an inlet relief in communication with the inlet of the pump and an outlet relief in communication with the outlet of the pump, the inlet and outlet reliefs defining a respective relieved portion, and wherein the bridge region of the bearing surface is defined between the inlet and outlet reliefs.

5. A bearing arrangement as claimed in claim 4, wherein one or more of the relieved portions of the bearing surface is provided with a drilling or passage which communicates with a through bore provided in the respective bearing block to permit a supply of lubricating fluid within said bore.

6. The bearing arrangement as claimed in claim 1, wherein one or more of the block housings is provided with a coating.

* * * * *